United States Patent [19]

Bryant

[11] 4,353,172

[45] Oct. 12, 1982

[54] CRAMPON BINDING

[76] Inventor: Mark K. Bryant, 23709 65th Ave. Ct. East, Graham, Wash. 98338

[21] Appl. No.: 205,747

[22] Filed: Nov. 10, 1980

[51] Int. Cl.[3] ..... A43B 3/10

[52] U.S. Cl. ..... 36/7.6; 36/62

[58] Field of Search ..... 36/7.6, 7.7, 62, 59 R; 24/68 SK

[56] References Cited

FOREIGN PATENT DOCUMENTS

| | | | |
|---|---|---|---|
| 78975 | 11/1919 | Austria | 36/7.6 |
| 2381484 | 10/1978 | France | 36/7.6 |
| 229623 | 2/1944 | Switzerland | 36/7.6 |
| 288393 | 5/1953 | Switzerland | 36/7.6 |

*Primary Examiner*—Richard J. Scanlan, Jr.
*Attorney, Agent, or Firm*—Roy E. Mattern, Jr.

[57] ABSTRACT

A crampon binding for convenient installation on mountaineers' crampons comprises a cooperative assembly of various sizes of neoprene elongated extensioners each especially contoured and equipped with centerline openings, to be adjustable folded over longitudinally, to extend from the sides of mountaineers' boots adjacent the sole edges up alongside the boot to the lacing eyelets or lacing hooks, to serve as tension members carrying the binding loads. When installed they are folded over conventional securement rings already secured to conventional small uprights spaced about coventional crampons. Their adjustable folded over longitudinal length is maintained upon installing aluminum screw posts, with their respective aluminum locking washer, through their selected aligned centerline openings. The contour of these extensioners provides progressively wider portions to contact the mountaineer's boot to more uniformly distribute the compression binding loads into the boot. At their upper ends aluminum dee rings are secured to the neoprene extensioners by using steel clips, neoprene clip backers or tabs, aluminum rivets, and aluminum backing washers. At least one toe located neoprene extensioner is optionally, without the installation of a dee ring, instead being threadedly secured to the end of a continuous webbed lacing, and at least one heel located neoprene extensioner is optionally, without the installation of a dee ring, instead receiving a steel alligator buckle, which is secured by using a neoprene folded over buckle tab, aluminum rivets, and aluminum backing washers. Preferably a nylon like fabric webbed lacing completes the cooperative assembly and is optionally threadably secured to a toe located neoprene extensioner and is long enough to be laced: diagonally across to a neoprene extensioner positioned at the ball of the foot locale along the boot: back directly across the boot to the opposite neoprene extensioner positoned at the ball of the foot locale; then diagonally forward to the other neoprene extensioner at the toe locale; thereafter diagonally back to the upper end of the neoprene extensioner secured at the heel locale; and then directly across the boot to be secured at the optionally installed alligator buckle on the upper end of the other neoprene extensioner secured, at the heel locale of the mountaineers' boot, to the mountaineers' conventional crampon.

5 Claims, 33 Drawing Figures

CRAMPON BINDING

BACKGROUND OF THE INVENTION

In the book, Mountaineering, Freedom of the Hills, by Harvey Manning 222 it is said, "The method of crampon attachment is fully as important as crampon style. Best of all is a buckle-and-rivet harness of oiled, chrome-tanned leather, non-slip harness buckles with holes in the straps are recommended. The leather does not freeze and therefore permits rapid putting-on and taking-off during cold climbs with much alternation of ice and rock. Nylon cord is inexpensive, easily removed, and easily replaced in an emergency. Special care must be taken to lace tightly and to run the lace through each attachment prong or ring, and to tie off the ends with a double knot. Web strapping is the least desirable, since it readily picks up snow and frequently freezes at the buckles, sometimes making it necessary to cut straps to remove crampons. The slip-type buckles commonly used with strapping have been known to break."

Also a review of U.S. Patents indicates for a century inventors have provided traction members for installation on shoes and boots to help persons walk and climb on packed snow and ice. Straps in various configurations have been used to removably secure the traction members on the shoes or boots, such as shown in U.S. Patents.

U.S. Pat. No. 390,594
U.S. Pat. No. 411,512
U.S. Pat. No. 442,003
U.S. Pat. No. 559,923
U.S. Pat. No. 577,475
U.S. Pat. No. 1,506,662
U.S. Pat. No. 1,837,730
U.S. Pat. No. 1,995,975
U.S. Pat. No. 2,047,593
U.S. Pat. No. 2,313,099
U.S. Pat. No. 2,441,998
U.S. Pat. No. 3,095,657
U.S. Pat. No. 3,229,389

Most, if not all of these previously listed patents concern traction members which mountaineers, who ascend the higher glacier covered mountains, would not rely on. More recent patents:

U.S. Pat No. 3,685,173
U.S. Pat. No. 3,786,579 are more representative of crampons which mountaineers would consider using.

In U.S. Pat. No. 3,685,173, Aldo Piazza discloses his crampon which is adjustably sized to a mountaineer's boot and thereafter secured directly to the sole and thereby to the boot, without the additional requirement of using securing belts. He eliminated the use of securing belts because he said when they become "wet due to the lowering of the temperature they become shorter and thus exert a notable pressure against the foot and prevent blood from circulating and sometimes aid frost-bite to occur". Much earlier in U.S. Pat. No. 1,008,773, Andrew E. Balser, provided an antislipping device for shoes also not requiring straps, but his antislipping device is probably not suitable for mountaineering boots. In U.S. Pat. No. 3,786,579 James Clark and Larry Gearheard disclose their adjustable crampons which in regard to the metal portions thereof are adjustably fitted differently than the so called conventional crampon illustrated herein, but the arrangement of the three pairs of strap posts are substantially the same. Conventionally a continuous strap is laced through the respective slots or rings of these strap posts, with the slots or rings being located alongside the mountaineer's boot near or at the sole locale of the boot.

In respect to this so called present use of conventional crampons with such posts terminating in slots or rings, the conventional strap lacing has a number of critical drawbacks. These relatively narrow straps when tightened often cut off blood circulation in a mountaineer's foot, which under low temperatures may also initiate frost-bite. These lacing straps, if made of leather, when wet and cold do shrink, also causing the tightening of the straps, and resulting in cutting off ones circulation. The posts with slots or the posts with rings often are very tightly located adjacent the sides of soles of the boot and/or the low sides of the boot when the boot is fitted with the crampon. Because of these low lacing slots or rings, the lacing must be done in these low elevation side locations under quite cumbersome conditions. Moreover the low slots and/or rings often become packed with snow further hindering the lacing procedures. In addition these lowly positioned slots or rings on the crampons, make it essentially impossible to lace the strap with gloves or mittens on. Yet if a climber or mountaineer removes his or her gloves to undertake such lacing under severe low temperature conditions, his or her hands could become frost-bitten and/or stick to the frozen metal crampon. Also the present so called conventional lacing arrangement includes a strap portion which extends, i.e. runs, lowly across the toe portion of the mountaineer's boot. Because of the often inefficiency of the entire lacing strap arrangement, this low strap portion across the toe portion often slips off the boot, causing the entire strap to loosen, and often causing the crampon itself to slip off the mountaineer's boot. Moreover, the conventional crampon and the lacing of the strap does not presently involve a set way or procedure of lacing. Beginning mountaineers are confused and troubled by the lacing steps. In addition the overall lacing is slowly undertaken both in putting on and taking off the crampons, whether or not the lacing is being undertaken by a beginner, i.e. novice, or an experienced mountaineer.

SUMMARY OF THE INVENTION

A crampon binding is provided to mountaineers for installation on their conventional crampons which are generally used in severe climbing conditions, which thereafter makes their securement and removal of their crampons to their mountaineering boots a convenient, fast, and safe, operation. Present drawbacks are eliminated and new advantages are gained. This crampon binding centers on the utilization of three pairs of variable sized neoprene elongated extensioners or elements, which extend from the slots or rings of crampon posts located alongside the soles or lower sides of the mountaineers' boots up ot the lacing and/or buckling locale of these boots, i.e. essentially along the top of these boots. Then at this convenient top location, lacing by using a strap is very quickly, conveniently, and safely undertaken, as a strap, preferably threadably secured to a toe located extensioner, is passed through rings located at the top ends of other extensioners, until finally buckled at a near heel to instep located extensioner, following a lacing pattern easily undertaken, which completes the excellent securement of the crampon to the mountaineers' boots.

These variable sized neoprene elongated extensioners are increased in width, having tapering sides, thereby creating their greater surface area for transferring binding forces and consequently no longer causing the cutting off of the blood circulation in a foot of a mountaineer. The overall arrangement of the extensioners and laced straps more evenly distributes the binding pressures throughout a boot and consequently throughout a mountaineer's foot. Maximum securement is obtained without creating any excessive stress point or locale.

This crampon binding is laced even when a mountaineer keeps his or her gloves on, as the strap is manipulated and secured or released, and consequently there is no chance of bare hands touching and sticking to the bare cold metal of crampons, or becoming frost-bitten. The lacing pattern eliminates the former cross toe strap portion, so no longer is there the resulting danger of the lacing of the straps becoming loose with the possible loss of the crampon. The lacing is conveniently undertaken along the top of the boot, even though the mountaineer is standing on a steep mountainside. At all times the lacing pattern is easily followed, and both novice and experienced climbers may quickly secure and/or release their crampons to or from their mountaineers' boots. Moreover this crampon binding is easily fitted to all six post crampons and respective boots, resulting in a safe, snug, overall fit. As necessary this crampon binding is adjustable to other crampons to continue to provide the top lacing position and to continue to provide the better distribution of the binding stresses throughout mountaineers' boots, and consequently to his or her feet.

DESCRIPTION OF THE DRAWINGS

A preferred embodiment of the crampon binding is illustrated in the drawings with respect to its use on a conventional six post, two piece joined together, crampon, with the posts terminating in loops or rings permanently secured upon bending over of the top portions of the posts.

in FIGS. 6, 7, and 8 the three sizes of neoprene extensioners; in FIGS. 9 and 10 the neoprene buckle tab and the neoprene clip tab; in FIGS. 11, 12, 13, 14 and 15 the aluminum parts, i.e. backing washer, locking washer, rivet, screw post, dee ring; in FIGS. 16, 17 the steel parts, i.e. buckle and clip; and in FIG. 18, a piece of webbing used as the strap for lacing;

DESCRIPTION OF THE PREFERRED EMBODIMENT OF THE INVENTION

Figure 1:
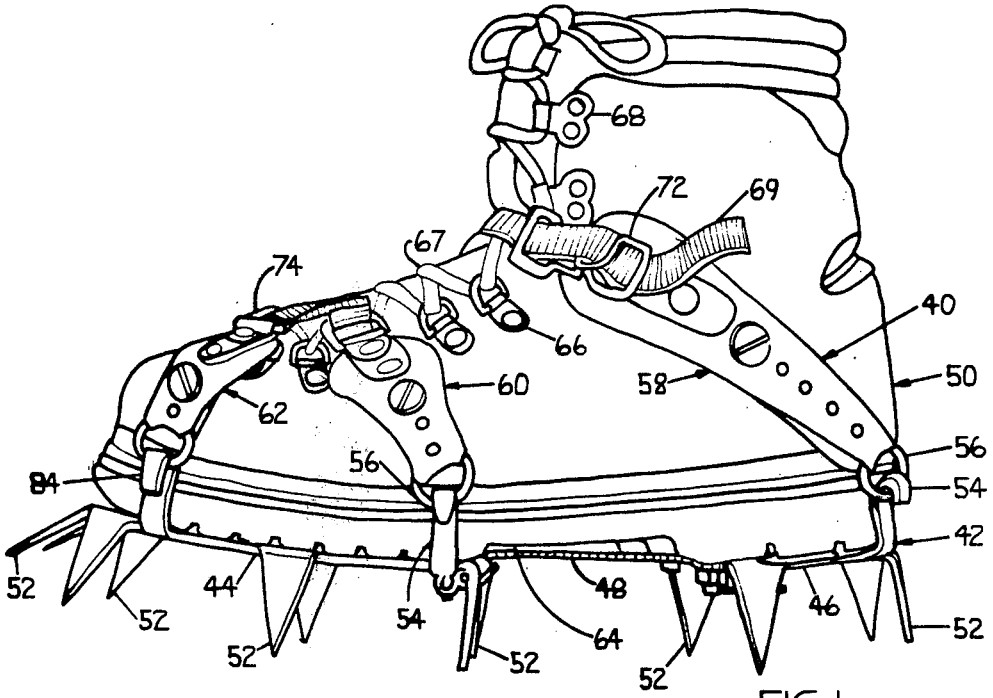
FIG. 1 is a side view of the left side of a mountaineer's boot for his or her left foot showing the six post crampon secured by this crampon binding.
Figure 2:
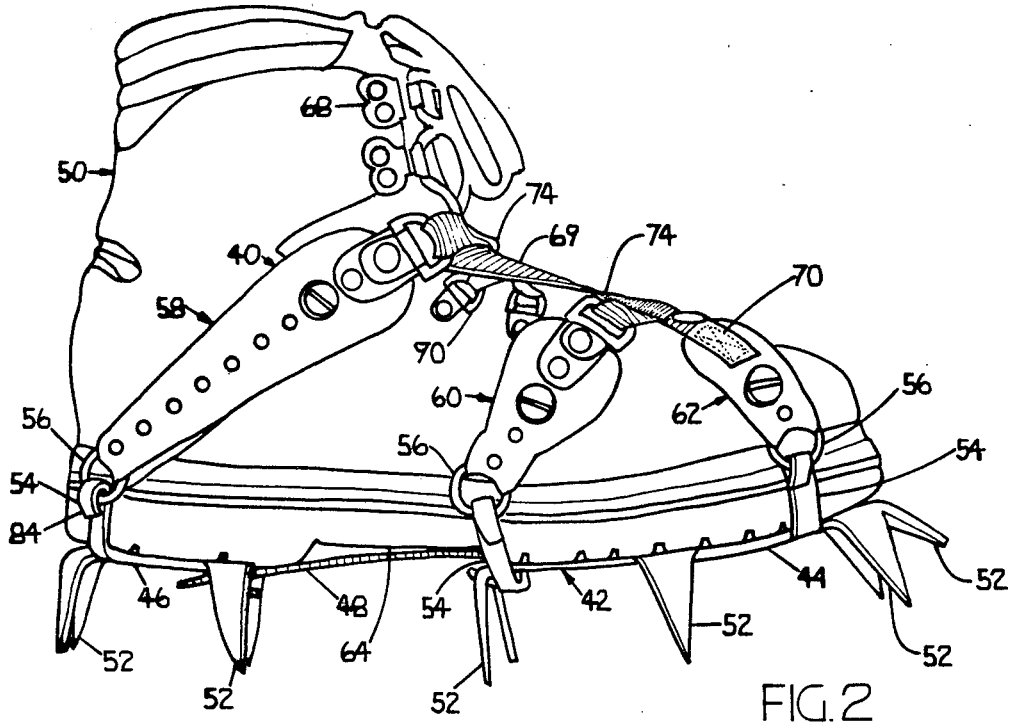
FIG. 2 is a side view of the right side of the boot, crampon, and crampon binding shown in FIG. 1.
Figure 3:
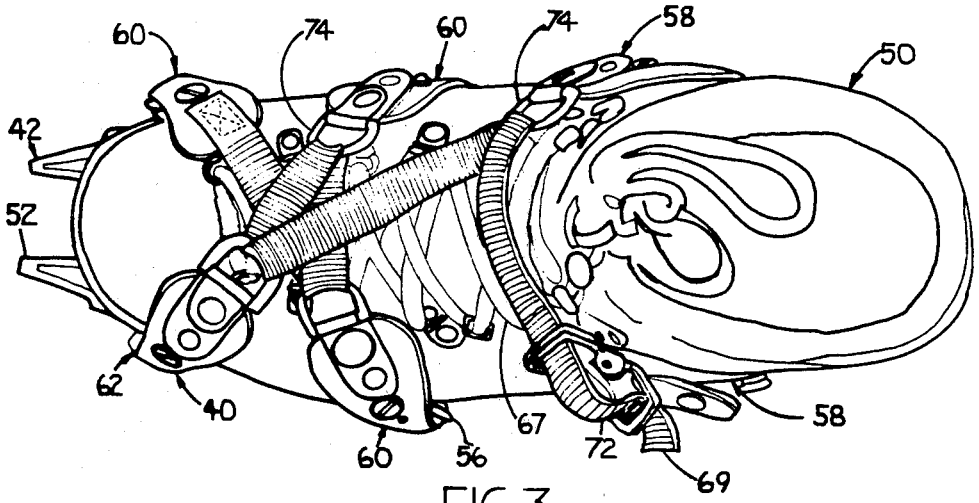
FIG. 3 is a top view of the boot, crampon, and crampon binding, illustrated in FIGS. 1 and 2.
Figure 4:
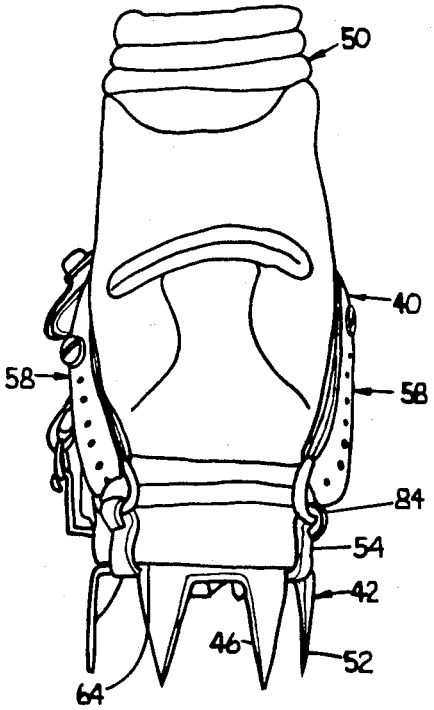
FIG. 4 is a rear view of the boot, crampon, and crampon binding, shown in FIGS. 1, 2, and 3.
Figure 5:
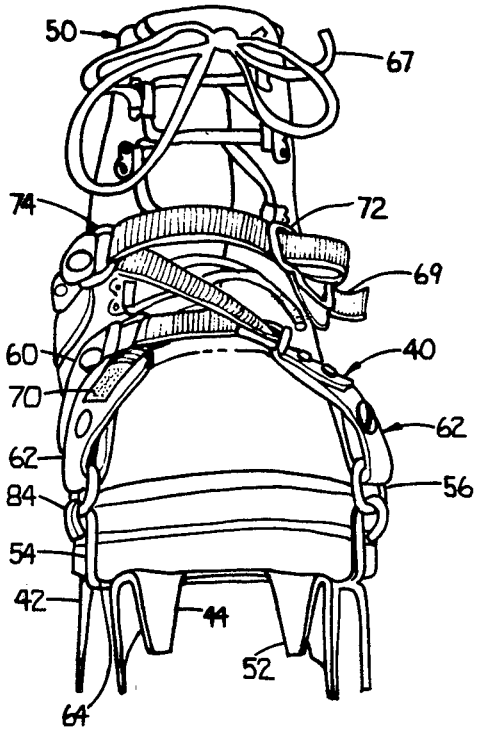
FIG. 5 is a front view of the boot, crampon, and crampon binding, shown in FIGS. 1, 2, 3, and 4.
Figure 6:
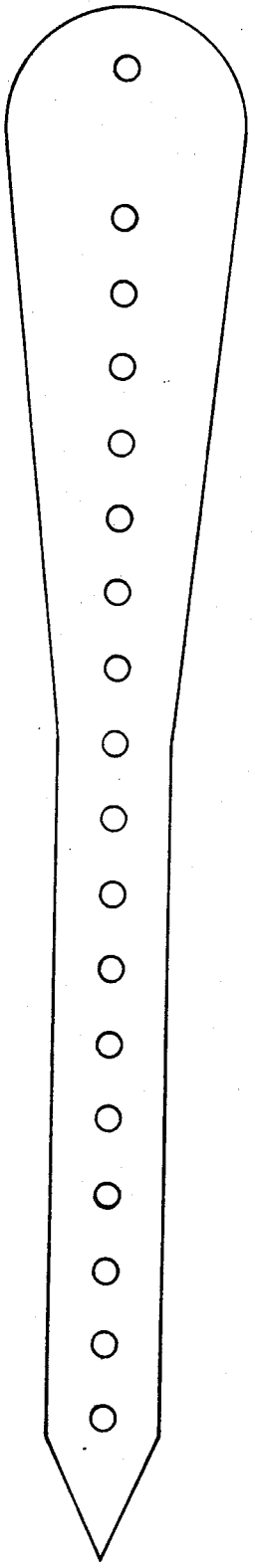
FIGS. 6 through 18 illustrate the respective components used in making the crampon binding, showing.
Figure 7:
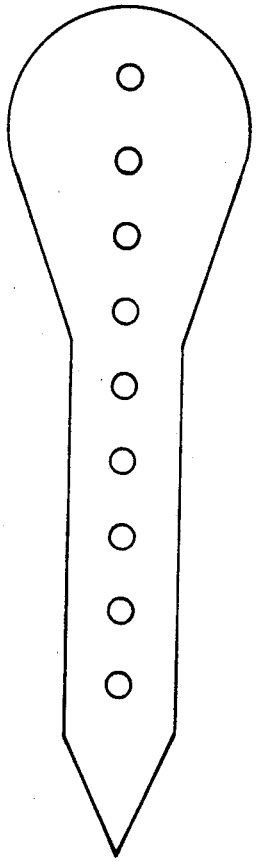
Figure 8:
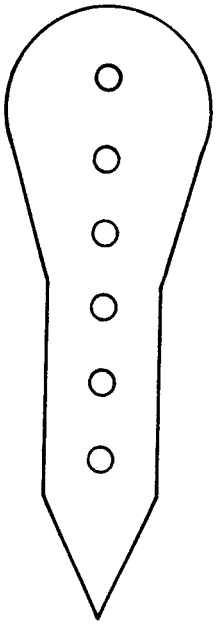
Figure 9:
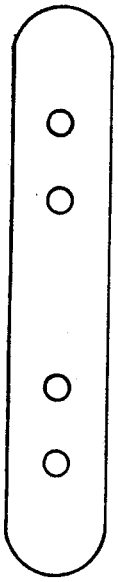
Figure 10:
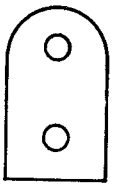
Figure 11:
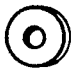
Figure 12:
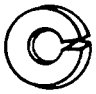
Figure 13:
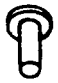
Figure 16:
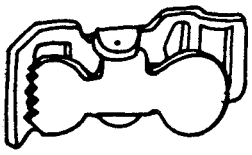
Figure 14:
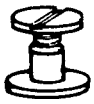
Figure 17:
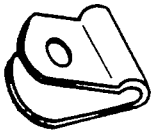
Figure 15:
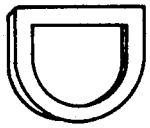
Figure 18:
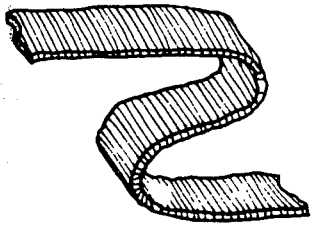

Throughout all the FIGS. 1 through 33, a preferred embodiment of this crampon binding 40 is illustrated. As shown in FIGS. 1 through 5, the crampon binding 40 is used to hold a conventional multi-piece crampon 42, having a toe 44, heel 46, and joining link 48 portions, on a conventional mountaineer's boot 50. A twelve point, 52 crampon is shown having six posts 54, each being equipped with a ring 56. Three sets of extensioners are used, a long set 58, a medium size set 60, and shorter set 62, with each extensioner being secured to a respective ring 56 and extending upwardly from the side of the sole 64 of the mountaineer's boot 50 to the lacing 66 and/or buckling 68 locale on top of the boot 50 where laces 67 are used. The upper ends of the extensioners receive a strap 69, either by threading 70, by buckling 72 or by passing through a dee ring 74, secured to the extensioners along the top of the montaineers's boot 50, to complete the securement of the crampon 42 to the boot 50 using this crampon binding 40.

In FIGS. 6 through 18, the respective types of starting components of the crampon binding 40 are illustrated. There are the three sizes of neoprene extensioners 58, 60, and 62, each of which is further adjustable as portions are folded over and centerline holes are aligned to receive a screw post 80, after the respective extensioner at its narrow end 82 is passed through a ring 56 on a post 54 of the crampon 42. Generally the ring 56 is secured on the conventional crampon 42 by bending over and clamping the upper post end 84. Additional neoprene portions are used to increase the strength of the crampon 40 with the buckle tab 86 being used at the buckle 72, and the clip tab 88 being used at clips 90, which hold the dee rings 74 in place upon the securement of rivets 92. These rivets are also used at other places, and often with backing washers 94. Also locking washers 96 are used with the screw posts 80. The strap 69 is a nylon webbing or like webbing.

Figure 19:
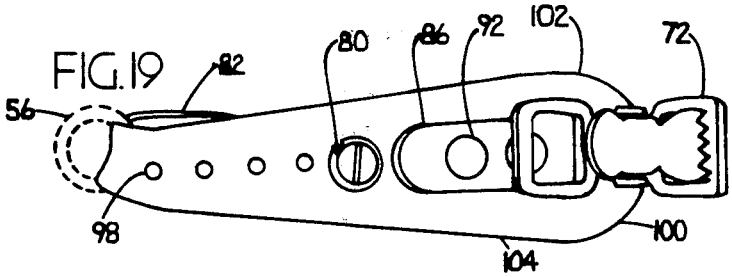
FIGS. 19, 20 and 21 illustrate the longer extensioner which is equipped with the buckle, with the dotted lines indicating the ring of the conventional crampon located at a post.
Figure 20:
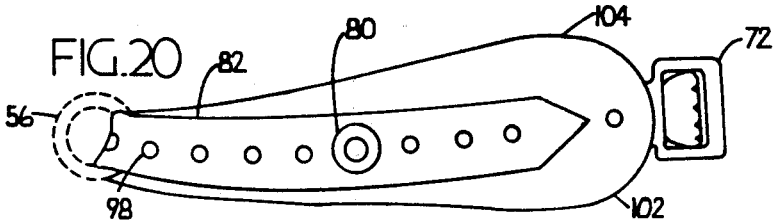
Figure 21:
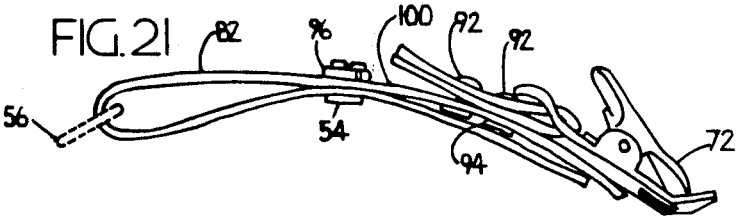

In FIGS. 19, 20, and 21, the assembly of a longer extensioner 58 is shown in respect to the one receiving the buckle 72. Its narrow end 82 is passed through the ring 56, shown in dotted lines, of the crampon post, not shown, and upon determination of the desired length, two of the centerline holes 98 are aligned and a screw post 80 with its locking washer 96 is fastened to maintain this selected length and to complete the securement of the extensioner 58 to the ring 56. At the top end 100 of the extensioner which is wider, as the respective sides 102, 104 of each extensioner are tapered outwardly, the buckle 72 is secured using the neoprene buckle tab 86, two rivets 92 and two backing washers 94.

Figure 22:
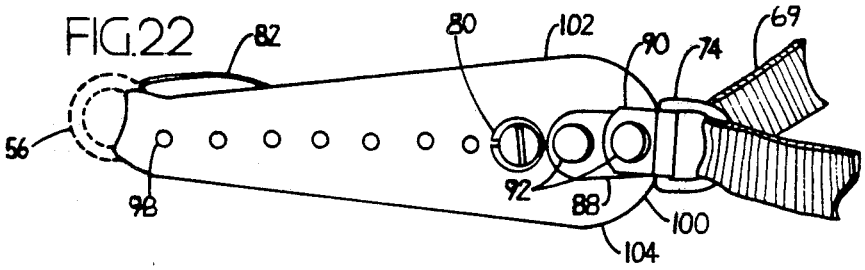
FIGS. 22, 23, and 24 illustrate the longer extensioner which is equipped with a dee ring, indicating how the strap is laced through the dee ring, with the dotted lines indicating the post located ring of a conventional crampon.
Figure 23:
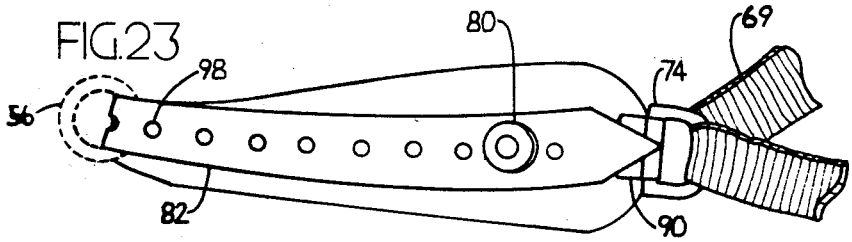
Figure 24:
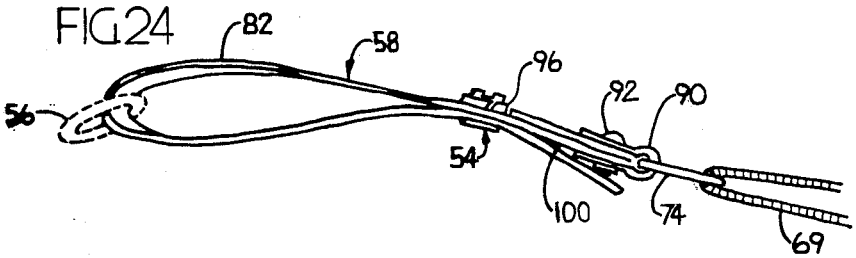

In FIGS. 22, 23 and 24, the assembly of the other longer extensioner 58 is shown in respect to receiving a dee ring 74, using the neoprene clip tab 88, the clip 90, and two rivets 92 and one backing washer 94. The remainder of the installation is like the installation of the longer extensioner 58 which received the buckle 72, as illustrated in FIGS. 19, 20 and 21.

Figure 25:
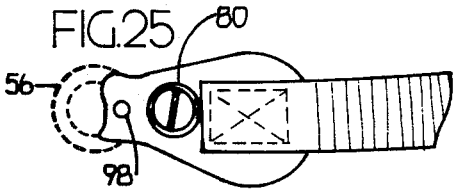
FIGS. 25, 26 and 27 illustrate one of the shorter extensioners to which the strap is threadably secured, with dotted lines indicating a post ring of crampons.
Figure 26:
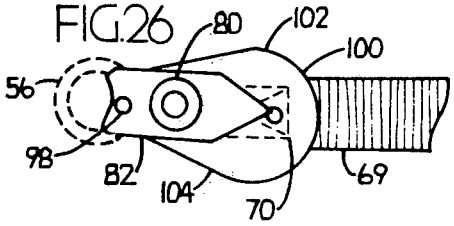
Figure 27:
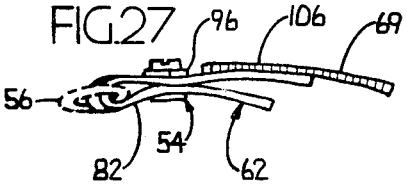

In FIGS. 25, 26, and 27, the assembly of a shorter extensioner 62 is illustrated in respect to the one threadably receiving the starting end 106 of the strap 69. This extensioner is secured to the ring 56 after its passing through the ring 56 and its folding over of its narrow end 82, as the screw post 80 and locking washer 96 are secured through aligned centerline holes 98.

Figure 28:
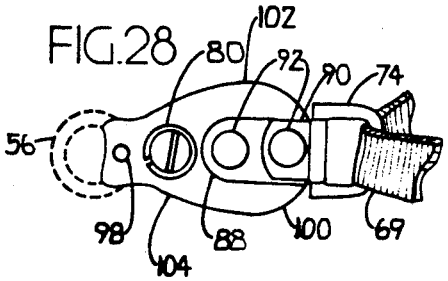
FIGS. 28, 29 and 30 illustrate the other shorter extensioner having a dee ring, with dotted lines indicating a post ring of crampons.
Figure 29:
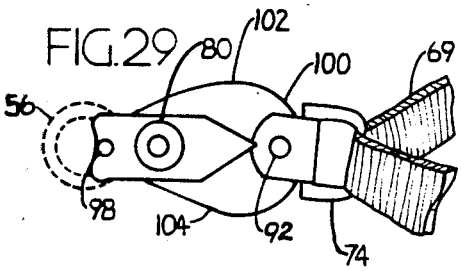
Figure 30:
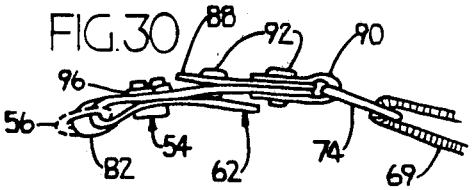

In FIGS. 28, 29, and 30, the assembly of the other shorter extensioner 62 is shown with the difference being the provision of a dee ring 74 to subsequently receive the lacing strap 69. The dee ring 74 is secured to the larger top end 100, again resulting from the outwardly tapering sides 102, 104, by utilizing a neoprene clip tab 88, a clip 90, two rivets, and one backing washer.

Figure 31:
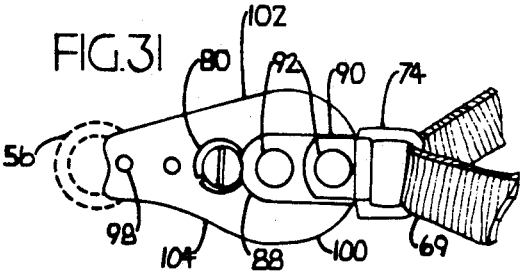
FIGS. 31, 32 and 33 show one of the two alike mid-size extensioners both having a dee ring, with dotted lines indicating a post ring of conventional crampons.
Figure 32:
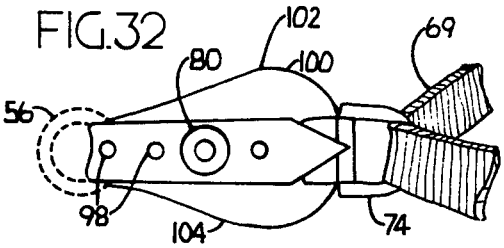
Figure 33:
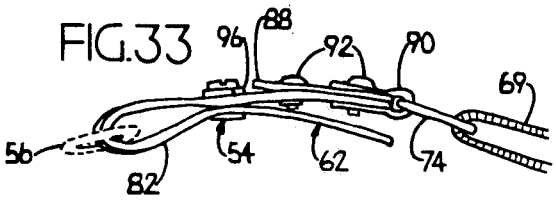

In FIGS. 31, 32, and 33, the two alike medium size extensioners are illustrated. Each one has its narrow end 82 eventually laced through the ring 56 of a crampon post, when the crampon binding 40 is being fitted to a crampon 42 and a boot 50 combination of a mountaineer. Thereafter after the selected resulting length is determined, as two selected aligned center holes 98 receive the respective portions of a screw post 80 and its locking washer 96, which are then tightened. The tapered sides 102, 104 create the larger top end 100 which receives the dee ring 74, in turn secured by using the clip 90, neoprene clip tab 88, two rivets 92, and a backing washer 94.

I claim:

1. A crampon binding for holding crampons on mountaineers' boots, comprising:

(a) pairs of elongated extensioners adapted to extend from securement locales on crampons which in use become located alongside sides of soles of mountaineers' boots, upwardly to boot lacing locales, each extensioner of all of the paired extensioners increasing in width along the extensioner between each securement locale on a crampon and each boot lacing locale to create a larger area of the extensioner for the transfer of compression binding forces to a mountaineer's boot;

(b) fasteners adapted to attach the elongated extensioners to a crampon at a securement locale;

(c) continuous webbed lacing adapted to removably secure the crampon to a mountaineers's boot by securing this continuous webbed lacing to each of the elongated extensioners at a boot lacing locale; and (d) fasteners to secure the continuous webbed lacing to each of the elongated extensioners at a boot lacing locale.

2. A crampon binding, as defined in claim 1, wherein the pairs of elongated extensioners have each of their elongated extensioners adapted to be adjustably lengthened or shortened, and wherein the fasteners which secure the continuous webbed lacing to each of the elongated extensioners at the boot lacing locale, include a threaded fastening of one end of the continuous webbed lacing to upper end of one elongated extensioner, a buckle fastening of the other end of the continuous webbed lacing to the upper end of another elongated extensioner, and ring fastenings of the remaining upper ends of the other elongated extensioners, as the continuous webbed lacing is passed through the ring fastening.

3. A crampon binding as defined in either claim 1 or 2 wherein the elongated extensioners are adjustable in length by folding over a portion of their length and securing the folded portions in place on the elongated extensioners.

4. A crampon binding for holding crampons on a mountaineer's boots, comprising:

(a) pairs of elongated extensioners, each of the elongated extensioners having an upper end and lower end, each of the elongated extensioners being ajdustable in length, and each of the elongated extensioners extending from a securement locale on the crampon, which in use becomes located alongside sides of soles of mountaineers' boots, upwardly to a boot lacing locale, and each of the elongated extensioners increases in width between securement locales on a crampon and a boot lacing locale and each of the elongated extensioners are adapted to be folded over for a portion of each extensioner's length and to be secured with the folded portion held in place, following the insertion of the lower end of elongated extensioner through a conventional receiving structure on a crampon at a securement locale;

(b) fasteners adapted to attach the elongated extensioners to a crampon at a securement locale;

(c) continuous webbed lacing, adapted to removably secure the crampon to a mountaineer's boot by securing this continuous webbed lacing to each of the elongated extensioners at a boot lacing locale; and (d) fasteners to secure the continuous webbed lacing to each of the elongated extensioners at a boot lacing locale, where these fasteners include the threaded fastening of one end of the continuous webbed lacing to the upper end of one elongated extensioner, the buckle fastening of the other end of the continuous webbed lacing to the upper end of another elongated extensioner and ring fastenings of the remaining upper ends of the other elongated extensioners, as the continuous webbed lacing is passed through the ring fastenings.

5. A crampon binding, as defined in claim 2 or 4 wherein the buckle fastening and the ring fastenings include respective clips and rivets to complete their respective fastenings to the respective elongated extensioners.

* * * * *